US010653219B2

(12) United States Patent
Camburn et al.

(10) Patent No.: US 10,653,219 B2
(45) Date of Patent: May 19, 2020

(54) TECTONIC ORIGAMI DEVICE

(71) Applicant: Singapore University of Technology and Design, Singapore (SG)

(72) Inventors: Bradley Camburn, Singapore (SG); Kristin Wood, Singapore (SG)

(73) Assignee: Singapore University of Technology and Design, Singapore (SG)

( * ) Notice: Subject to any disclaimer, the term of this patent is extended or adjusted under 35 U.S.C. 154(b) by 0 days.

(21) Appl. No.: 15/571,490

(22) PCT Filed: May 6, 2016

(86) PCT No.: PCT/SG2016/050209

§ 371 (c)(1),
(2) Date: Nov. 2, 2017

(87) PCT Pub. No.: WO2016/178632

PCT Pub. Date: Nov. 10, 2016

(65) Prior Publication Data

US 2018/0132583 A1 May 17, 2018

(30) Foreign Application Priority Data

May 7, 2015 (SG) ..... 10201503609W

(51) Int. Cl.

| | |
|---|---|
| ***A63H 33/16*** | (2006.01) |
| ***A45C 7/00*** | (2006.01) |
| ***A45C 3/00*** | (2006.01) |

(52) U.S. Cl.

CPC ..... *A45C 7/0077* (2013.01); *A45C 3/001* (2013.01); *A45C 7/00* (2013.01); *A63H 33/16* (2013.01); *A45C 2007/0004* (2013.01)

(58) Field of Classification Search

CPC ..... A45C 7/0054; A45C 7/0095; A45C 2007/004; B65D 9/12; B65D 9/14;
(Continued)

(56) References Cited

U.S. PATENT DOCUMENTS 2,703,415 A * 3/1955 Bechik ..... A47C 31/08 5/703
3,164,478 A * 1/1965 Bostrom ..... B65D 85/36 206/303

(Continued)

FOREIGN PATENT DOCUMENTS

DE 20201475 U1 4/2002
FR 2990686 A3 11/2013

(Continued)

OTHER PUBLICATIONS

International Search Report & Written Opinion dated Jun. 21, 2016 from International PCT Application No. PCT/SG2016/050209.

*Primary Examiner* — Allan D Stevens
(74) *Attorney, Agent, or Firm* — Innovation Capital Law Group, LLP; Vic Lin

(57) ABSTRACT

A tectonic origami device (100) is disclosed, which includes a flexible supporting substrate (102); and a plurality of substantially rigid planar members (104) arranged on the supporting substrate, the planar members configured in a non-overlapping cooperative arrangement to permit assembly of the device to form an enclosure. The device is configured to be transformable between a collapsed form where the supporting substrate and planar members are collectively in a planar arrangement and an assembled form where the supporting substrate and planar members are collectively assembled as the enclosure.

9 Claims, 8 Drawing Sheets

(58) Field of Classification Search
CPC ..... B65D 5/008; B65D 5/009; B65D 5/4287; B65D 5/6611; B65D 5/643; B65D 5/063; B65D 5/066; B65D 5/069; B65D 5/3692; B65D 5/6647; B65D 5/6673; B65D 11/1833; B65D 11/186; B65D 11/18; B65D 88/52; B65D 88/522; B65D 2251/1025; A63H 33/16
USPC ..... 220/7, 6, 666; 446/478, 109, 80, 487, 446/488
See application file for complete search history.

(56) References Cited

U.S. PATENT DOCUMENTS 3,789,522 A * 2/1974 Moore ..... A47B 43/00 434/433
4,509,645 A * 4/1985 Hotta ..... A45C 11/20 206/545
5,542,870 A * 8/1996 Westersund ..... A63H 33/062 220/324
7,188,713 B1 * 3/2007 Espar ..... A45C 7/0095 190/107
7,395,621 B2 * 7/2008 Carter ..... G09F 1/00 229/115
8,544,216 B1 * 10/2013 Hazlett ..... E04H 1/1205 135/143
2006/0169690 A1 * 8/2006 Rothschild ..... A45C 7/0036 220/7
2009/0090709 A1 4/2009 Shalomoff
2010/0129007 A1 * 5/2010 McCoy ..... B65D 33/065 383/7
2014/0001247 A1 * 1/2014 Valesini Gegembauer ..... B65D 5/009 229/108
2015/0122196 A1 * 5/2015 Liu ..... A01K 1/0254 119/497

FOREIGN PATENT DOCUMENTS

WO 2000002634 A1 1/2000
WO WO-2004088615 A1 * 10/2004 ..... A63F 9/1204
WO 2004088615 A1 10/2014

* cited by examiner

TECTONIC ORIGAMI DEVICE

FIELD

The present invention relates to a tectonic origami device.

BACKGROUND

There are two relevant design tracks in the state of the art for origami inspired structures. There are a number of designs that focus on regular repeating plates. These are typically connected with hinge joints. These designs include volumes that are open at one or both sides. A very simple example of this is expanding solar panels on satellites or the retracting roof of a stadium. These designs typically feature expansion in one dimension and cannot be used to form closed volumes. Another design is an origami inspired handbag, which can be opened at one side, and consists of regular repeating soft triangles. The current designs however leave at least one face open.

One object of the present invention is therefore to address at least one of the problems of the prior art and/or to provide a choice that is useful in the art.

SUMMARY

According to a 1$^{st}$ aspect, there is provided a tectonic origami device comprising: a flexible supporting substrate; and a plurality of substantially rigid planar members arranged on the supporting substrate, the planar members configured in a non-overlapping cooperative arrangement to permit assembly of the device to form an enclosure. The device is configured to be transformable between a collapsed form where the supporting substrate and planar members are collectively in a planar arrangement and an assembled form where the supporting substrate and planar members are collectively assembled as the enclosure.

Advantageously, the device has a flexible configuration in which it may reversibly and rapidly transform between the collapsed and assembled forms. Particularly, the collapsed form makes it easy to stow the device when needed, while the assembled form can easily be deployed to provide substantial structural rigidity for the device in functioning as an enclosure (e.g. a bag) to store loose items.

Preferably, each planar member may include a plate.

Preferably, the plate may include being formed of cardboard, plastic, wood or a composite material.

Preferably, the supporting substrate may include felt or canvas.

Preferably, the device further comprises a locking cap having a plurality of female members, and the device includes a plurality of male members, wherein in the assembled form, the male members are received into the respective female members to enable the locking cap to hold the enclosure in the assembled form using interference friction locking.

Preferably, the female member may include a slot and the male member may include a pin.

Preferably, each planar member may include being formed in a polygonal shape.

Preferably, the polygonal shape may include a triangle, a pentagon, or a toroid. It is also to be appreciated that asymmetric variants of these fundamental shapes are possible as well, which include pyramid and prism.

Preferably, the planar members may alternatively include first and second plurality of planar members, each of the first plurality having a first polygonal shape and each of the second plurality having a second polygonal shape which is different to the first polygonal shape.

Preferably, at least some of the planar members may include decorative images formed on respective surfaces thereof.

Preferably, the device may further include a plurality of elastic cords attached respectively to at least some of the planar members to enable the device to transform from the collapsed form to the assembled form by pulling the elastic cords collectively in a direction in opposition to a platform on which the device is positioned.

According to a 2$^{nd}$ aspect, there is provided a method of operating a tectonic origami device, which includes a flexible supporting substrate and a plurality of planar members arranged on the supporting substrate, the planar members configured in a non-overlapping cooperative arrangement to permit assembly of the device to form an enclosure. The method comprises: configuring the device to transform between a collapsed form where the supporting substrate and planar members are collectively in a planar arrangement, and an assembled form where the supporting substrate and planar members are collectively assembled as the enclosure.

According to a 3$^{rd}$ aspect, there is provided a method for manufacturing the tectonic origami device, the method comprising: determining a shape of the enclosure of the device; forming the shape of the enclosure from a planar element, the formation causing markings to be formed on the planar element; and determining characteristics of the planar members based on the markings formed on the planar element.

Preferably, determining characteristics of the planar members comprises: based on the markings, identifying areas on the planar element corresponding to surfaces providing the shape of the enclosure when the planar element is formed into the enclosure; providing the supporting substrate as the planar element; and determining shapes and locations of the planar members to be arranged on the supporting substrate based respectively on shapes and locations of the identified areas.

It should be apparent that features relating to one aspect of the invention may also be applicable to the other aspects of the invention.

These and other aspects of the invention will be apparent from and elucidated with reference to the embodiments described hereinafter.

BRIEF DESCRIPTION OF THE DRAWINGS

Embodiments of the invention are disclosed hereinafter with reference to the accompanying drawings, in which.

DETAILED DESCRIPTION OF PREFERRED EMBODIMENTS

A tectonic origami device 100 (hereafter abbreviated as "device"), according to an embodiment, is shown in FIGS.

Figure 1A:
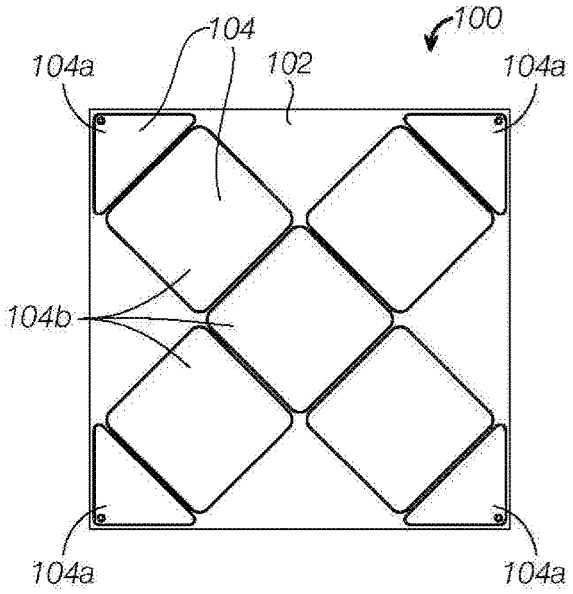
FIGS. 1A to 1D show a tectonic origami device, according to an embodiment.
Figure 1B:
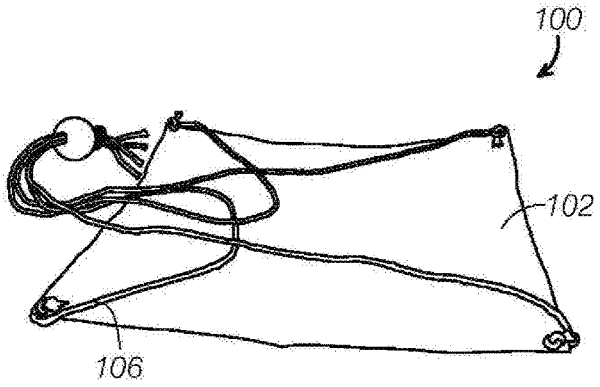
Figure 1C:
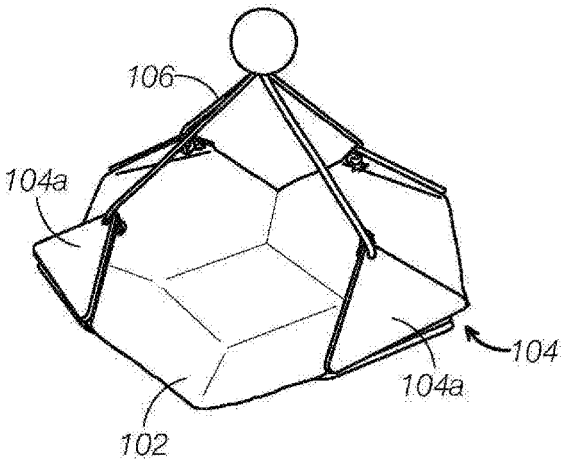
Figure 1D:
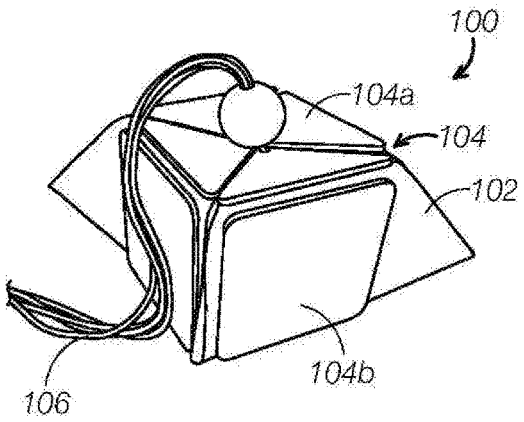
Figure 2A:
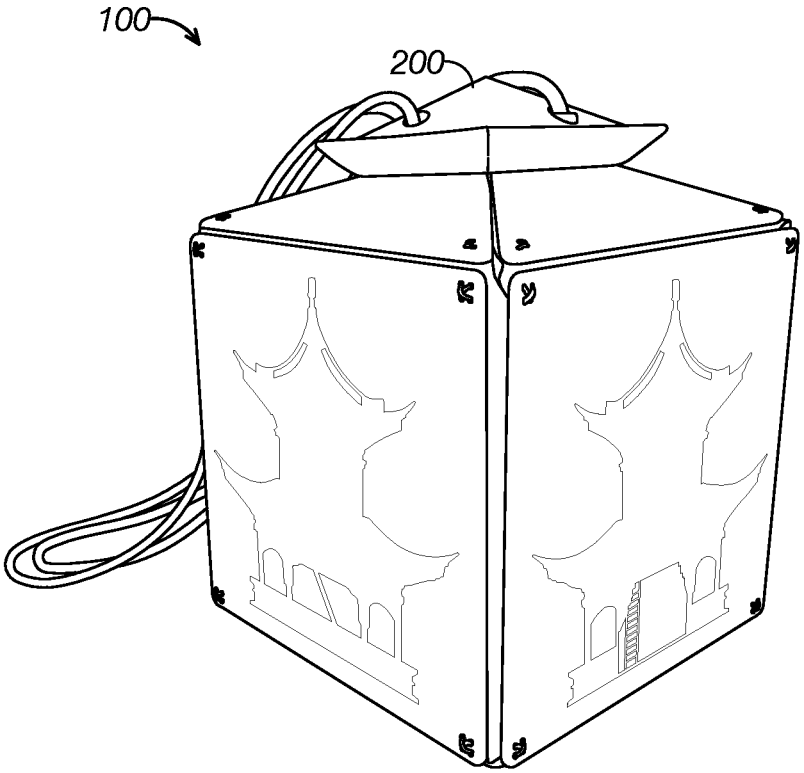
FIGS. 2A to 2E show different perspective views of a locking cap for use with the device of FIGS. 1A to 1D.
Figure 2B:
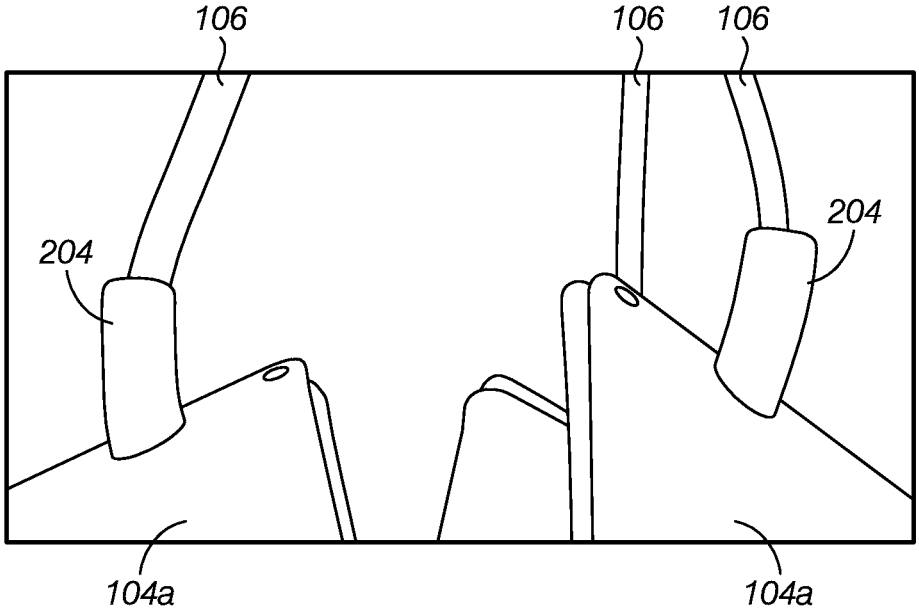
Figure 2C:
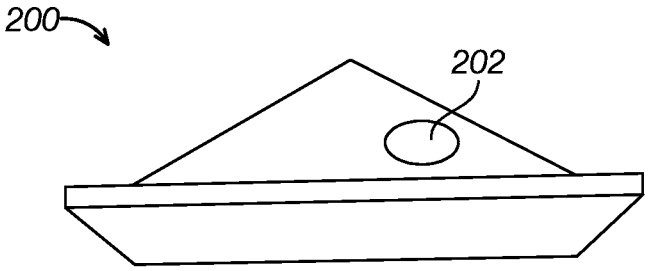
Figure 2D:
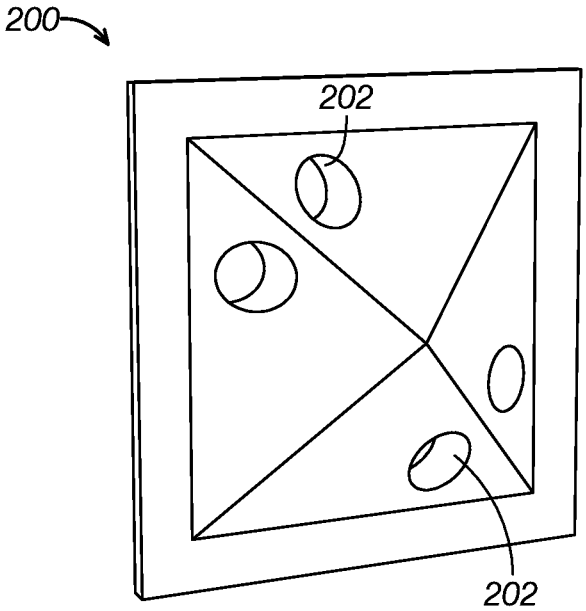
Figure 2E:
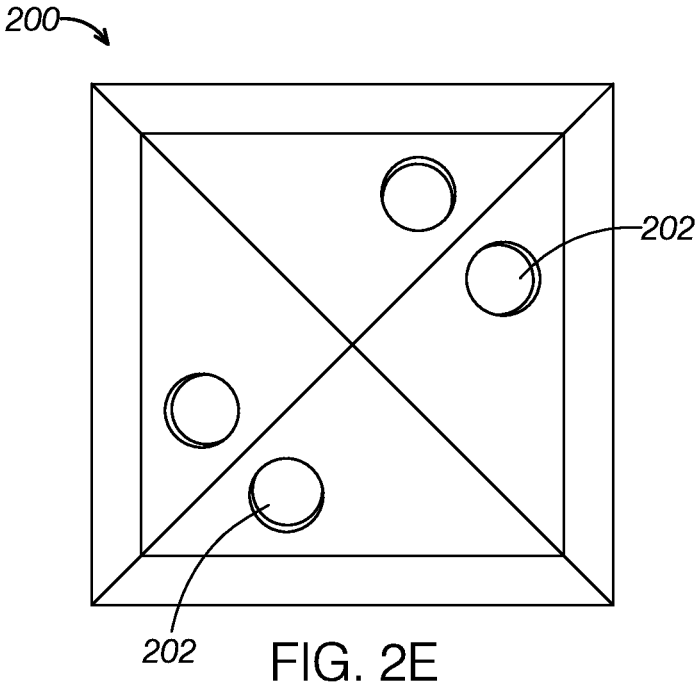
Figure 3A:
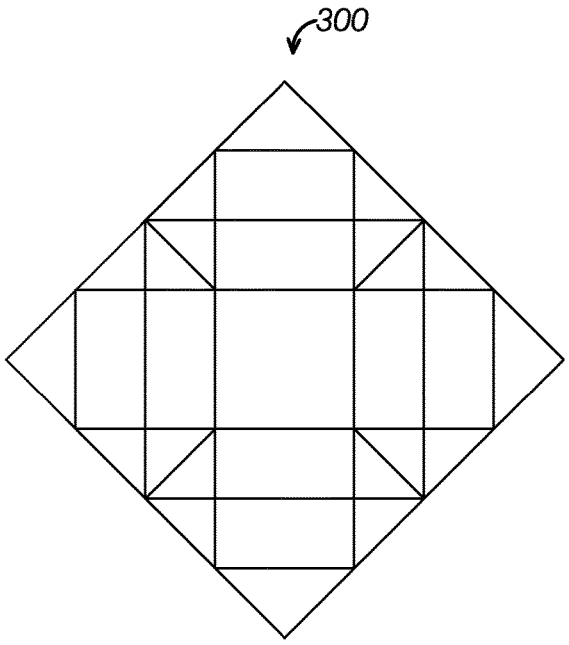
FIGS. 3A to 3D show a first phase of a method for manufacturing the device of FIGS. 1A to 1D.
Figure 3B:
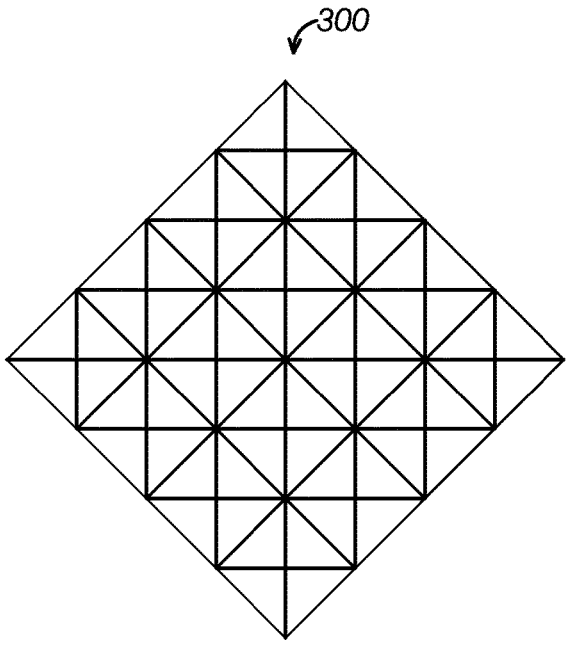
Figure 3C:
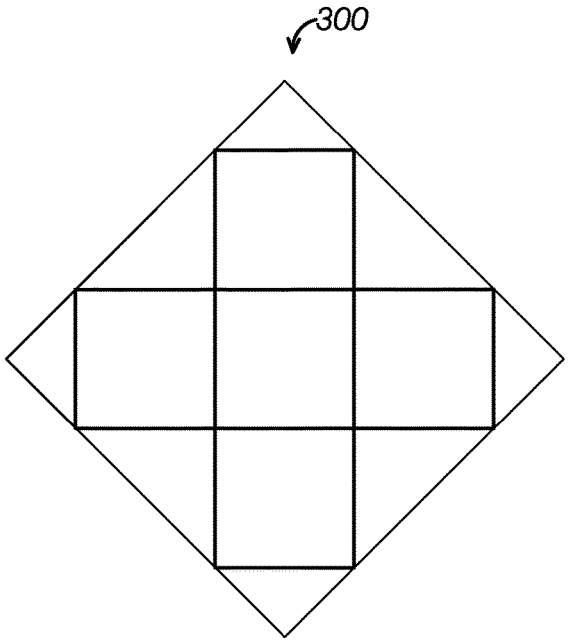
Figure 3D:
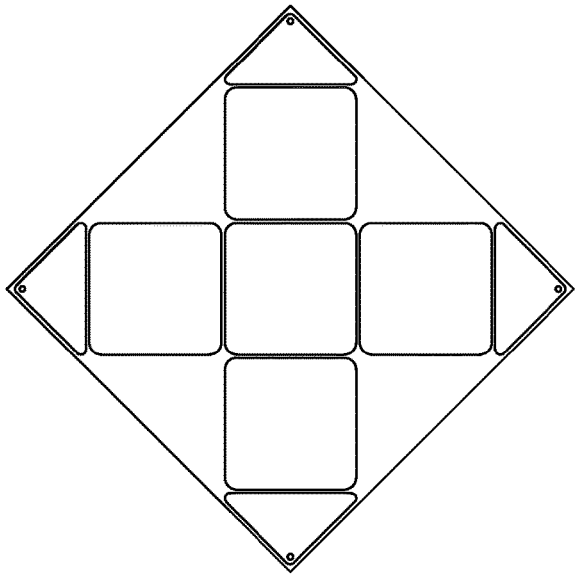
Figure 4A:
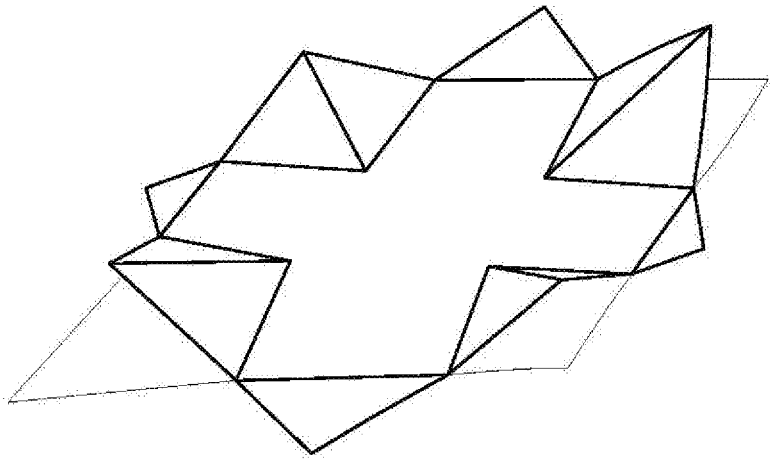
FIGS. 4A and 4B and FIGS. 5A through 5D are respectively second and third phases of the method for manufacturing the device of FIGS. 1A to 1D.
Figure 4B:
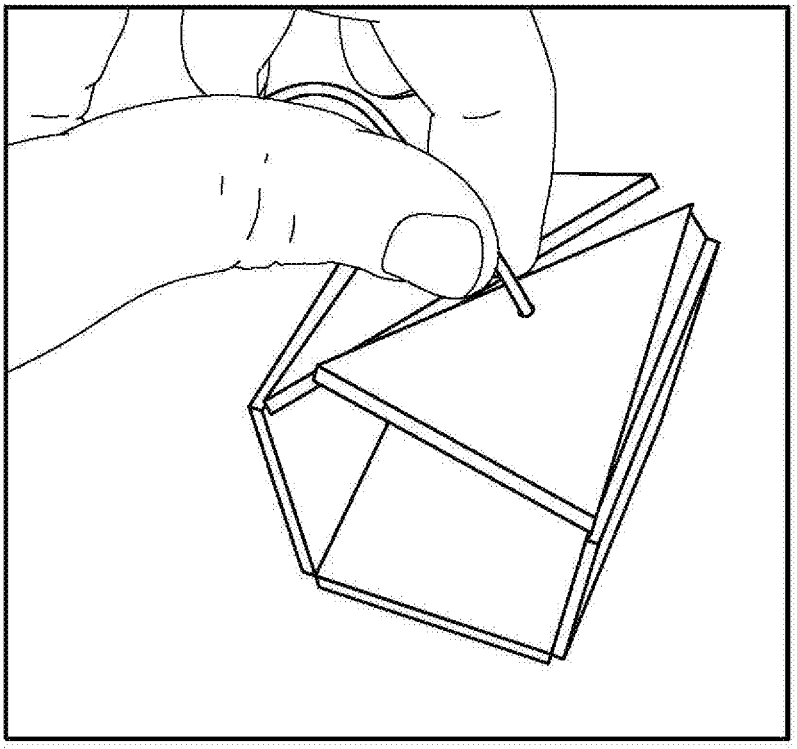
Figure 5A:
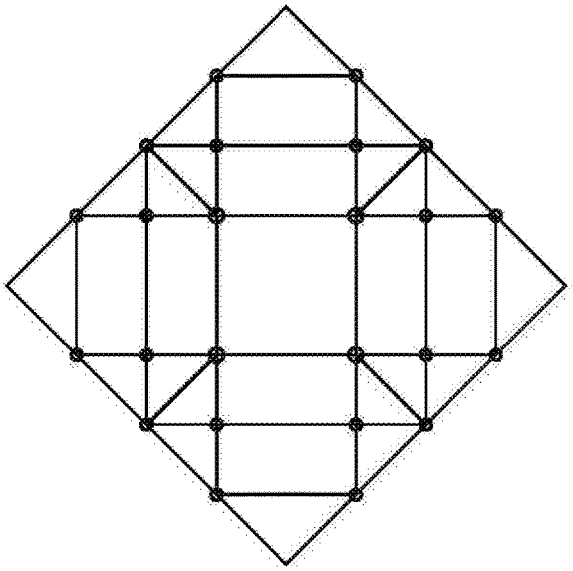
Figure 5B:
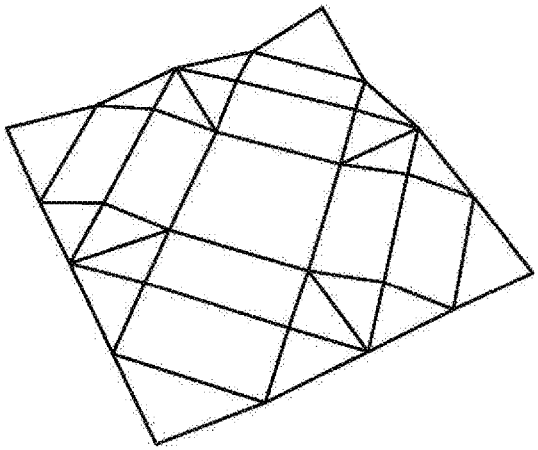
Figure 5C:
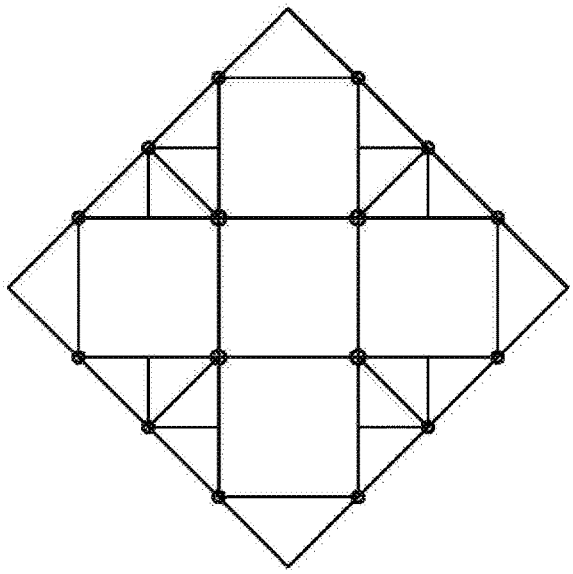
Figure 5D:
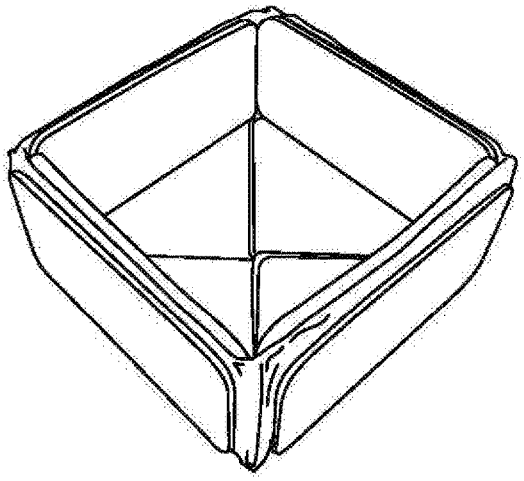

1A to 1D. The device 100 comprises a flexible supporting substrate 102, and a plurality of substantially rigid planar members 104 arranged on the supporting substrate 102. It is to be appreciated that the definition of substantially rigid includes both rigid and semi-rigid. The planar members 104 are non-removably arranged on the supporting substrate 102 using any suitable means, e.g. stitching or gluing with industrial adhesives/tapes. The supporting substrate 102 may be formed of a suitable material, such as felt or canvas, depending on an application intended for the device 100. For this embodiment, the supporting substrate 102 has a double stitched denim inner lining. The planar members 104 are configured in a non-overlapping cooperative arrangement to permit assembly of the device 100 (i.e. the supporting substrate 102 in conjunction with the planar members 104) to form an enclosure (e.g. a cuboid box as depicted in FIG. 1D, which has dimensions of approximately measuring 15 cm in length by 15 cm in width by 19 cm in height).

The device 100 is configured to be transformable between a collapsed form (e.g. see FIGS. 1A and 1B) where the supporting substrate 102 and planar members 104 are collectively in a planar arrangement, and an assembled form (e.g. see FIG. 1D) where the supporting substrate 102 and the planar members 104 are collectively assembled as the enclosure (i.e. assembled enclosure). For completeness, it is to be appreciated that in FIG. 1A, planar members 104 that overlap when the device 100 is arranged in the assembled form have been removed. The device 100 is reversibly reconfigurable from the collapsed form to the assembled form, and vice-versa if necessary. In the collapsed form, the device 100 is in a configuration that facilitates stowage (e.g. for packing or storage purposes), whereas in the assembled form, the device 100 is transformed into a functional rigid-volume configuration where the assembled enclosure may be used (for example) as a bag to carry/store loose items.

In this case, each planar member 104 takes the form of a plate, although it is not to be construed as limiting. Each plate may be made of cardboard, plastic, wood, a composite material, or any other suitable low costs material as will be appreciated. For this embodiment, each planar member 104 is formed using acrylic. Moreover, each planar member 104 has a polygonal shape, e.g. a triangle, a pentagon, or a toroid. In this case, the planar members 104 include first and second plurality of planar members 104*a*, 104*b*, wherein each of the first plurality of planar members 104*a* has a first polygonal shape (e.g. a triangle shape) and each of the second plurality of planar members 104*b* has a second polygonal shape (e.g. a square shape) which is different to the first polygonal shape. This should not be construed as limiting because in variant embodiments, it is possible for all the planar members 104 to have only a single type of polygonal shape, or more than two types of polygonal shapes.

Briefly, tectonic origami is an origami-inspired manufacturing technique for devising a functional design, where there is a plurality of hard plates (e.g. the planar members 104) arranged on a soft substrate (e.g. the supporting substrate 102) to form the design. Beneficially, this arrangement permits configuration of a design that is transformable between a collapsed form to change to a planar arrangement, and an assembled form to change into a rigid structure (i.e. an enclosure). The planar members 104 are arranged to be coincident in terms of layout on the supporting substrate 102, where the planar members 104 are purposefully segmented along predetermined planar subdivisions or "tectonic" divisions. Specifically, the arrangement of the tectonics divisions is what enables the design to be able to be foldable to become the rigid structure. Needless to say, this arrangement can flexibly be adapted to design any type and shape of specific "folded" structural volumes.

FIGS. 2A to 2E show different perspective views of a locking cap (or lid) 200 for use with the device 100 of FIGS. 1A to 1D. It is to be appreciated that the locking cap 200 is an optional component of the device 100 in this embodiment (but could be included in variant embodiments), and the locking cap 200 may be produced using additive manufacturing (i.e. 3D printed). Also, the locking cap 200 shown in FIGS. 2A to 2E has a pyramid-like shape, although other shapes are possible too. Broadly, the locking cap 200 has a plurality of female members 202, and the device 100 itself includes a plurality of male members 204 formed on at least some of the planar members 104 (if the locking cap 200 is to be used with the device 100). In the assembled form of the device 100, the male members 204 are arranged to be received into the respective female members 202 to enable the locking cap 200 to hold/clasp the assembled enclosure in position using interference friction locking. Needless to say, the male members 204 are aligned to the respective female members 202 in this state. When the male members 204 are received into the respective female members 202, inner walls of the female members 202 in contact with the male members 204 frictionally engage the male members 204 such that overall, a secure and fairly tight arrangement is achieved by the locking cap 200 to provide interference locking for the device 100.

In this embodiment, the male members 204 are respectively formed only on the first plurality of planar members 104*a* which form the "roof" of the enclosure (i.e. top of the enclosure), when the device 100 is in the assembled form (e.g. see FIGS. 2A and 2B), since the locking cap 200 is intended to be used on the "roof" of the enclosure to achieve the locking. It is also to be appreciated that the locking cap 200 is to be formed of a sufficient thickness to enable the first plurality of planar members 104*a* to be firmly held together in place by the locking cap 200. In this instance, the female member 202 is configured as a through-slot (i.e. see FIGS. 2C to 2E) and the male member 204 is implemented as a pin/stub (i.e. see FIG. 2B), but are however not to be construed as limiting since other suitable configurations for the female and male members 202, 204 are also possible to realise interference friction locking.

Further, a way to actuate all the planar members 104 in one movement to enable transformation of the device 100 from the collapsed form to the assembled form is to provide four elastic cords 106 of equal length at each of the first plurality of planar members 104*a*. Without loss of generality, non-elastic cords, or rope-like cords may also be used in place of the elastic cords 106. Specifically, each cord 106 is (detachably or fixedly) coupled to each corresponding male member 104*a*. Hence, by pulling all four cords 106 in a single direction (e.g. pulling upwardly relative to a platform, on which the device 100 sits), the supporting substrate 102 and planar members 104 are collectively and concurrently drawn upwards, and consequently caused to close-up to form the enclosure due to the converging movement of the first plurality of planar members 104*a* towards one another as depicted in FIG. 1C. Once the first plurality of planar members 104*a* have fully converged to form the "roof" of the enclosure (i.e. the device 100 is now in the assembled form), the locking cap 200 is then lowered onto the "roof" of the enclosure (i.e. comprising the first plurality of planar members 104*a*), so that the female members 202 receive the male members 204 to securely clasp the enclosure in position using interference friction locking. Indeed, using a single motion by means of pulling the cords 106, the device 100 may quickly and easily be transformed from the collapsed form to the assembled form.

Further, a way to actuate all the planar members 104 in one movement to enable transformation of the device 100 from the collapsed form to the assembled form is to provide four elastic cords 106 of equal length at each of the first plurality of planar members 104*a*. Without loss of generality, non-elastic cords, or rope-like cords may also be used in place of the elastic cords 106. Specifically, each cord 106 is (detachably or fixedly) coupled to each corresponding male member 104*a*. Hence, by pulling all four cords 106 in a single direction (e.g. pulling upwardly relative to a platform, on which the device 100 sits), the supporting substrate 102 and planar members 104 are collectively and concurrently drawn upwards, and consequently caused to close-up to form the enclosure due to the converging movement of the first plurality of planar members 104*a* towards one another as depicted in FIG. 1*c*. Once the first plurality of planar members 104*a* have fully converged to form the "roof" of the enclosure (i.e. the device 100 is now in the assembled form), the locking cap 200 is then lowered onto the "roof" of the enclosure (i.e. comprising the first plurality of planar members 104*a*), so that the female members 202 receive the male members 204 to securely clasp the enclosure in position using interference friction locking. Indeed, using a single motion by means of pulling the cords 106, the device 100 may quickly and easily be transformed from the collapsed form to the assembled form.

Therefore, a method of operating the device 100 (of FIGS. 1A to 1D) broadly comprises configuring the device 100 (e.g. by pulling on the elastic cords 106 in a single motion as described above) to transform the device 100 between the collapsed form where the supporting substrate 102 and planar members 104 are collectively in the planar arrangement, and the assembled form where the supporting substrate 102 and planar members 104 are collectively assembled as the enclosure.

Figure 6:
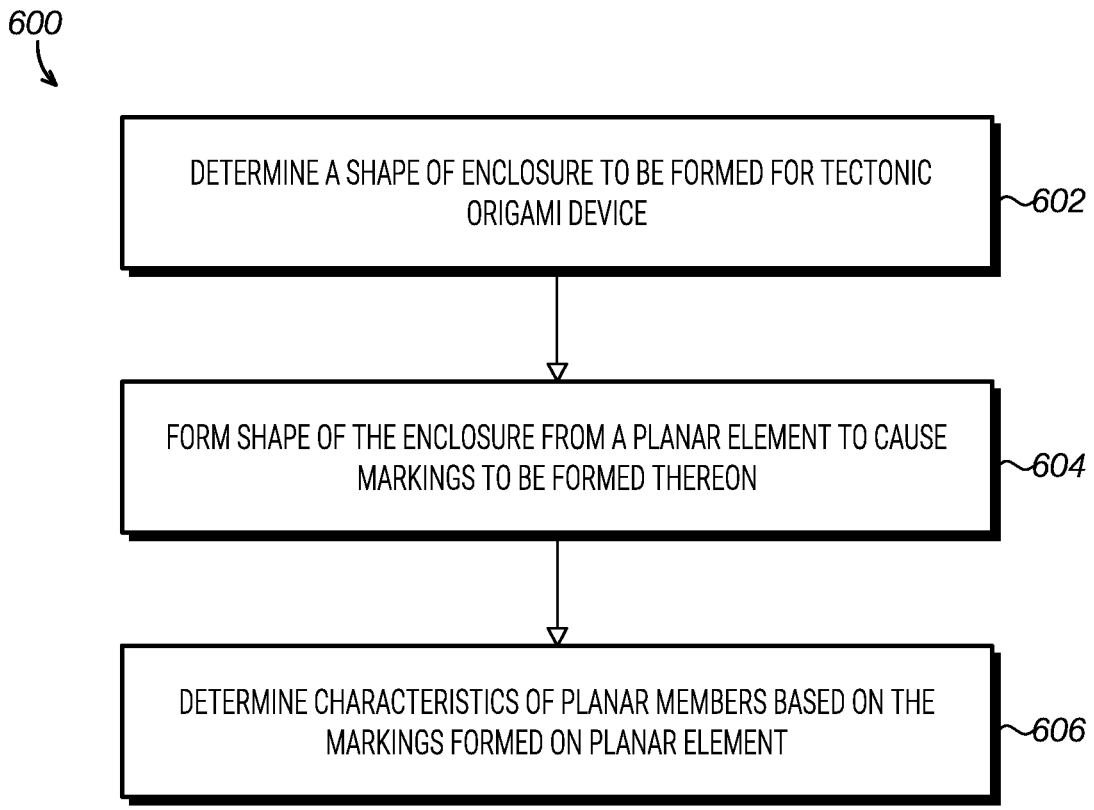
FIG. 6 is a flow diagram of the method for manufacturing the device of FIGS. 1A to 1D.

Next, FIGS. 3*a* to 3*d* depict a first phase of a method 600 for (designing and) manufacturing the device 100, whereas FIGS. 4A and 4B and FIGS. 5A through 5D are respectively second and third phases of the method 600 for manufacturing the device 100. Broad steps of the said method 600 for manufacturing the device 100 are depicted in a flow diagram of FIG. 6. Briefly, the method 600 begins by determining a desired shape of the enclosure to be formed by the device 100 (in the assembled form) at step 602, and then forming the shape of the enclosure from a planar element 300 (e.g. a piece of paper) at step 604 for initial prototyping purposes (i.e. see FIGS. 4A and 4B), in which the formation causes markings to be formed on the planar element 300 (i.e. see FIGS. 3A to 3D). The markings, also known as crease lines, subsequently result in formation of tectonic divisions (that are delimited by the respective markings) on the planar element 300.

Specifically, forming of the tectonic divisions on the planar element 300 is performed as illustrated in FIGS. 3A to 3D, which is an example pertaining to markings for forming an enclosure (by the device 100) in the shape of a box. The markings are identified by first folding the shape of the desired enclosure using the planar element 300, similar to origami. The folded planar element 300, now forming the enclosure, is then unfolded so that the markings can become visible for determining important tectonic divisions. Not limited to the foregoing described, the process of identifying the markings may also be accomplished computationally. Subsequently, the tectonic divisions formed on the planar element 300 are used to identify which subdivisions of the planar element 300 are to be arranged with the planar members 104 for providing rigidity to the eventually assembled enclosure. More importantly, at step 606 of the method 600, characteristics of the planar members 104 to be adopted based on the markings formed on the planar element 300 are determined—see next paragraph. Then, the tectonic divisions are replaced using the necessary planar members 104 that are to be arranged on the supporting substrate 102, being provided in place of the planar element 300, which is solely used for the initial prototyping at step 604.

To elaborate on determining characteristics of the planar members 104, it largely comprises: (1). based on the markings, identifying areas on the planar element 300 corresponding to surfaces providing the shape of the enclosure when the planar element 300 is formed into the enclosure; (2). providing the supporting substrate 102 as the planar element 300; and (3). determining shapes and locations/positions of the planar members 104 to be arranged on the supporting substrate 102 based respectively on shapes and locations of the identified areas.

An example of placing the planar members 104 over the tectonic divisions is illustrated in FIGS. 5A through 5D. This arrangement can be assembled into the enclosure, i.e. a box, which is fairly structurally rigid in the assembled form. This also contrasts from traditional origami in that a composite material is employed. Moreover, the structure can be further simplified to remove any overlapping planes in the assembled form, as described above.

In summary, the proposed device 100 is advantageous in able to attain substantial structural rigidity when assembled into the enclosure versus conventional solutions. Also, the device 100 may allow forming a variety of easy storage solutions with rapid deployment. The device 100 may find commercial markets in countries such as Singapore, United States, and Australia, and some envisaged useful applications of the device 100 include:

1. For usage as a commercial disposable gift bag that may easily be opened for accessing the interior. Using low costs material for the supporting substrate 102 and planar members 104, the disposable gift bag can be mass-produced at relatively low costs and can be of substantial use as a packing solution, due to the beneficial compact storage requirements offered by the device 100 and ease of assembly (in which only a single motion is required).

2. For usage as a backpack, a purse, or a laptop bag with high structural integrity, that offer very easy access to items stored inside (as compared to other existing hard-shell bags on the market). In this instance, the planar members 104 may be made of plastic, wood, or a durable composite material, while the supporting substrate 102 may (for example) be made of cloth from a heavy bag type canvas material. The planar members 104 may then either be attached to the supporting substrate 102 with rivets, stitching, or with an industrial adhesive (or some suitable combination of all techniques).

3. For usage in rescue operations (e.g. configuring the device 100 with appropriate dimensions to be used as deployable structures, such as tents), in aerospace applications (e.g. using the device 100 for development of a toroid for producing artificial gravity in space), or in toy designs or corporate gift designs (e.g. a variety of toys for children could be based on the disclosed concept of the proposed device 100).

4. For usage as deployable furniture such as forming from the collapsed form (i.e. deployed for convenient packing) into structures like a stool, which may be formed in one embodiment as a polygonal solid. Such an object may have the dual capacity to act as a storage device as well as a piece of furniture and could be easily collapsed from the assembled form into the collapsed form for easy transportation and relocation, when required.

Generally, the proposed device 100 provides a fundamentally new structural rigidity to origami-inspired structures and a 'stand-alone' capacity, which has not yet been demonstrated in conventional solutions.

Figure 7A:
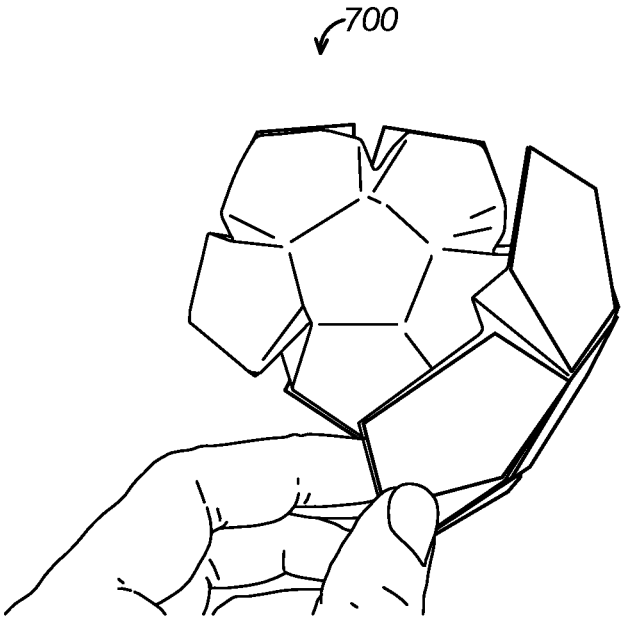
FIGS. 7A to 7D depict different variations of the device of FIGS. 1A to 1D.
Figure 7B:
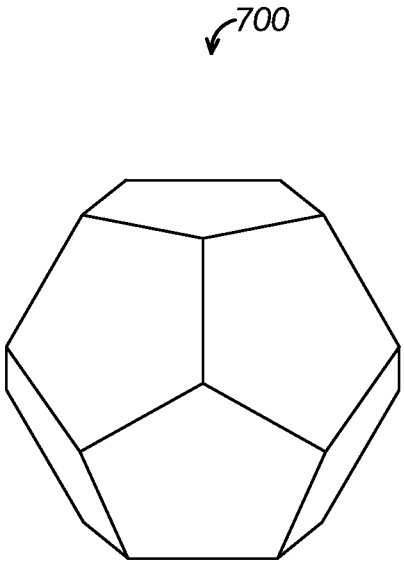
Figure 7C:
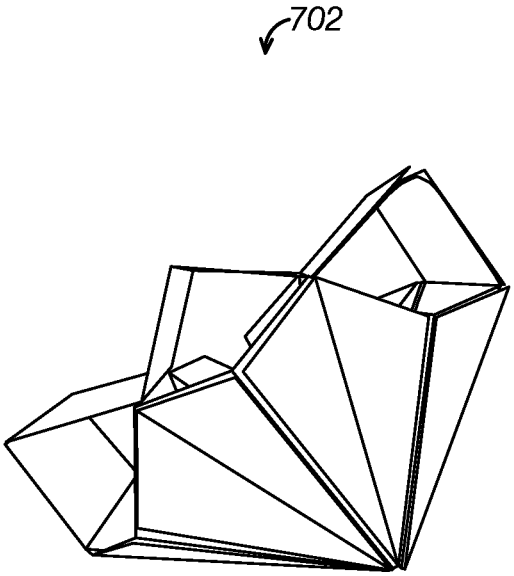
Figure 7D:
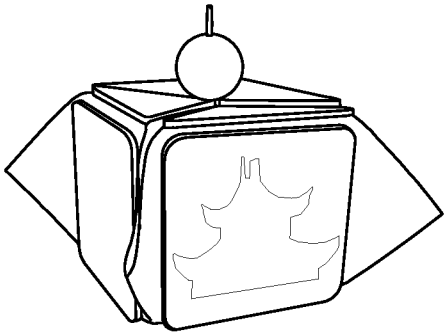

While the invention has been illustrated and described in detail in the drawings and foregoing description, such illustration and description are to be considered illustrative or exemplary, and not restrictive; the invention is not limited to the disclosed embodiments. Other variations to the disclosed embodiments can be understood and effected by those skilled in the art in practicing the claimed invention. For example, the supporting substrate 102 and planar members 104 may be appropriately configured with suitable shapes and sizes such that the enclosure formed may be of a variety of different shapes, e.g. as a dodecahedron 700 shown in FIGS. 7A and 7B, or as a toroid 702 shown in FIG. 7C. Moreover, respective surfaces of the planar members 104 may optionally be etched with desired aesthetic/decorative images, or formed (via any suitable methods) with 3D surfaces having profiled features, sculptures, or the like (i.e. see FIG. 7D). To clarify, the definition of "surfaces" in the preceding sentence means surfaces of the planar members 104 that form outwardly facing surfaces of the assembled enclosure that are immediately visible to a user. The locking cap 200 may also be replaced using a spring-stop toggle stopper (or similar like widgets), which may consequently simplify configuration of the device 100, since there is then no need for the male members 204 anymore.

In other variant embodiments, some portions of the flexible supporting substrate 102 are not necessarily covered by the planar members 104, i.e. those portions are not covered up. There may also be some regions that are open in the assembled enclosure, and so include regions with only a single layer, between the planar members 104, consisting solely of the flexible supporting substrate 102, which advantageously allows the proposed device 100 to have a smoother transformation between the collapsed form and the assembled form.

The invention claimed is:

1. A tectonic origami device comprising:

a flexible supporting substrate;

a plurality of planar members arranged on the supporting substrate, the planar members configured in a non-overlapping cooperative arrangement to permit assembly of the device to form an enclosure;

a plurality of male members; and a locking cap having a plurality of female members;

wherein the device is configured to be transformable between a collapsed form where the supporting substrate and planar members are collectively in a planar arrangement, and an assembled form where the supporting substrate and planar members are collectively caused to close up to form the enclosure, wherein, when the device is in the assembled form and as the locking cap engages the enclosure, the male members are received into the respective female members to enable the locking cap to hold the enclosure in the assembled form using interference friction locking; and wherein the tectonic origami device further includes a plurality of cords attached respectively to at least some of the planar members to enable the device to transform from the collapsed form to the assembled form by pulling the cords collectively in a direction in opposition to a platform on which the device is positioned, wherein the cords are arranged to guide movement of the locking cap with respect to the planar members.

2. The device of claim 1, wherein each planar member includes a plate.

3. The device of claim 2, wherein the plate includes being formed of cardboard, plastic, wood or a composite material.

4. The device of claim 1, wherein the supporting substrate includes felt or canvas.

5. The device of claim 1, wherein each of the plurality of female members includes a slot and each of the plurality of male members includes a pin.

6. The device of claim 1, wherein each planar member includes being formed in a polygonal shape.

7. The device of claim 6, wherein the planar members include first and second plurality of planar members, each of the first plurality having a first polygonal shape and each of the second plurality having a second polygonal shape which is different to the first polygonal shape, wherein the first polygonal shape has a first number of sides different from a second number of sides of the second polygonal shape.

8. The device of claim 1, wherein at least some of the planar members include decorative images formed on respective surfaces thereof.

9. A tectonic origami device comprising:

a flexible supporting substrate;

a plurality of planar members arranged on the supporting substrate, the planar members configured in a non-overlapping cooperative arrangement to permit assembly of the device to form an enclosure;

a plurality of male members; and a locking cap having a plurality of female members;

wherein the device is configured to be transformable between a collapsed form where the supporting substrate and planar members are collectively in a planar arrangement, and an assembled form where the supporting substrate and planar members are collectively caused to close up to form the enclosure, wherein, when the device is in the assembled form and as the locking cap engages the enclosure, the male members are received into the respective female members to enable the locking cap to hold the enclosure in the assembled form using interference friction locking;

wherein each planar member includes being formed in a polygonal shape; and wherein the planar members include first and second plurality of planar members, each of the first plurality having a first polygonal shape and each of the second plurality having a second polygonal shape which is different to the first polygonal shape, wherein the first polygonal shape has a first number of sides different from a second number of sides of the second polygonal shape.

* * * * *